US005769738A

United States Patent [19]

Kershaw et al.

[11] Patent Number: 5,769,738

[45] Date of Patent: Jun. 23, 1998

[54] GOLF PUTTER

[76] Inventors: Timothy Kershaw, 4 The Vale off Skull House La., Wigan, England, WN6 9HD; Christopher Gardner, Iby House Farm Station Road, Northwich, England, CW8 2RQ

[21] Appl. No.: 747,018

[22] Filed: Nov. 7, 1996

[30] Foreign Application Priority Data

| | | | |
|---|---|---|---|
| Nov. 8, 1995 | [GB] | United Kingdom | 9522895 |
| Apr. 12, 1996 | [GB] | United Kingdom | 9607582 |

[51] Int. Cl.[6] ..... A63B 53/04

[52] U.S. Cl. ..... 473/340

[58] Field of Search ..... 473/340, 324, 473/341

[56] References Cited

U.S. PATENT DOCUMENTS

| | | | |
|---|---|---|---|
| 4,312,509 | 1/1982 | Grant | 473/340 X |
| 4,522,405 | 6/1985 | Clawges | 473/340 |
| 4,867,457 | 9/1989 | Lowe | 473/341 |
| 5,058,895 | 10/1991 | Igarashi | 473/341 |
| 5,294,122 | 3/1994 | Longo | 473/340 X |
| 5,340,106 | 8/1994 | Ravaris | 473/341 X |
| 5,383,664 | 1/1995 | Epperson | 473/340 |
| 5,467,987 | 11/1995 | Perkins et al. | 473/340 |
| 5,605,510 | 2/1997 | Schmidt et al. | 473/340 X |

FOREIGN PATENT DOCUMENTS

| | | |
|---|---|---|
| 0 631 797 A1 | 1/1995 | European Pat. Off. . |
| 2 213 390 | 8/1989 | United Kingdom . |
| 2 236 954 | 4/1991 | United Kingdom . |
| 2 267 036 | 11/1993 | United Kingdom . |

*Primary Examiner*—Raleigh W. Chiu
*Attorney, Agent, or Firm*—Salter & Michaelson

[57] ABSTRACT

A golf putter which produces little or no skidding upon striking a golf ball. It promotes putting with improved consistency and accuracy by providing a putter head with a front surface intended to make contact with a golf ball and a base surface intended to rest on or be closely adjacent to the ground when the front surface makes contact with a golf ball. The front surface is located above the level of the base surface. The front surface and base surface and not adjacent.

9 Claims, 2 Drawing Sheets

GOLF PUTTER

This invention relates to a golf putter for striking a golf ball with improved results.

Putting is an important skill in the game of golf. It is known that a clean contact between putter and ball is desirable for consistent putting. However, with known types of putter the ball tends to skid across the surface of a green immediately after being struck. After this initial skidding the ball commences rolling.

In known designs of putter the striking face of the putter can make contact with a ball at a point below the equator of the ball, causing skidding. Skidding can also be caused if the centre of gravity of the putter head is lower than that of the ball when the face of the putter and the ball make contact.

The initial skidding of a golf ball associated with known putters is undesirable because it does not promote a good roll of the ball.

An object of the invention is to provide an improved golf putter which produces little or no skidding upon striking a golf ball and consequently promotes putting with improved consistency and accuracy.

According to the invention therefore there is provided a golf putter comprising a putter head with a front surface intended to make contact with a golf ball and a base surface intended to rest on or be closely adjacent to the ground when the front surface makes contact with a golf ball, wherein said front surface is located above the level of the base surface and wherein said front surface and the base surface are not adjacent.

Preferably the putter head has an angled cut away portion adjacent to the front surface and the base surface. The angled portion is sized so that the height of the front surface above the base surface enables the front surface to make contact with a golf ball at the equator of the ball but not substantially below the equator of the ball. This reduces the amount of skidding imparted to the ball upon contact compared to known putters.

The angled cut away portion produces a putter head with a higher centre of gravity compared to known putter heads. This tends to impart a good roll to the golf ball when contact is made. Preferably the centre of gravity of the putter head is located above the level of the centre of a golf ball resting on the ground when the base surface of the putter is closely adjacent to the ground.

The putter head is preferably cast or machined from metal or a metal alloy.

Alternatively, the putter head may be cast or moulded from a rubber or plastic material. It may also be oxtruded into shape. Any mouldable or extrudable material may be used to produce the putter head of the present invention.

The putter head may be provided with internal or oxternal weights as necessary or appropriate.

The putter head may have a portion of the base surface and part of the body of the putter head, cut away so as to alter the weight of the putter head. The shape of the portion cut away from the base surface and part of the body of the putter head may be altered co as to effect the type of performance required of the putter head.

The invention will now be described further by way of example only dad with reference to the accompanying drawings in which.

Figure 1:
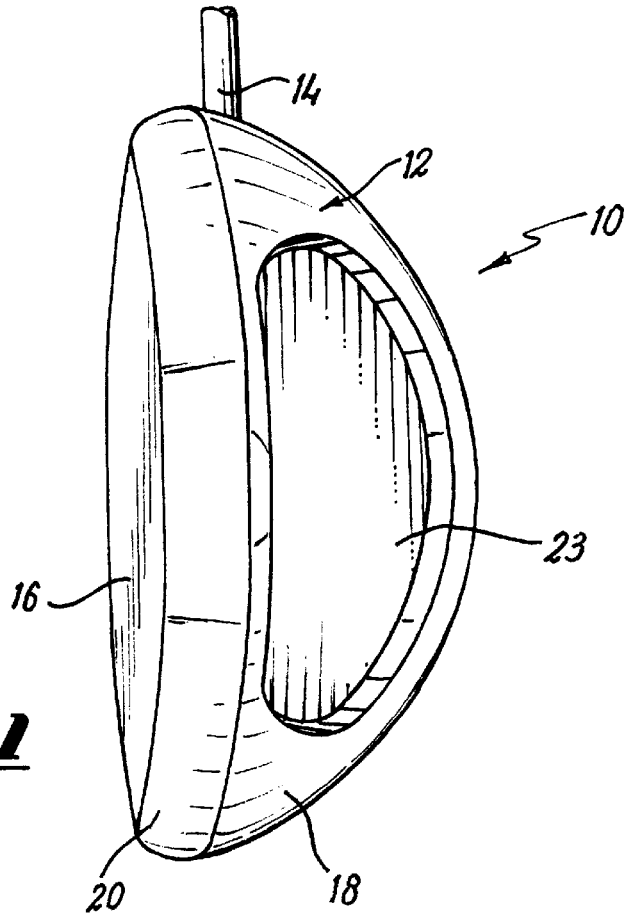
FIG. 1 is a perspective view showing the underside of a putter head in accordance with the invention.
Figure 2:
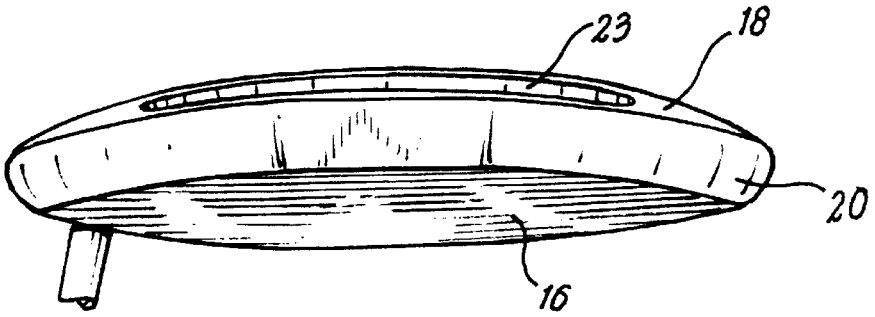
FIG. 2 is a another perspective view from a different angle, showing the underside of a putter head in accordance with the invention.
Figure 3:
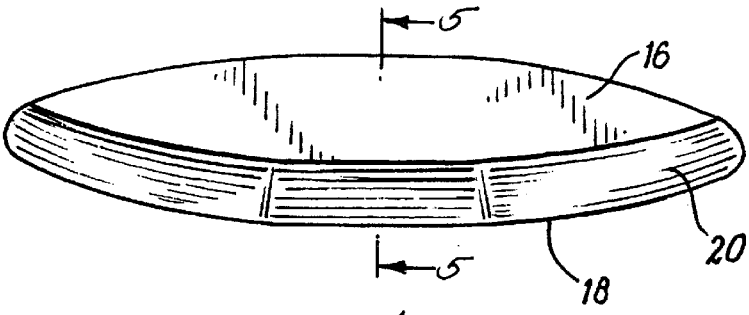
FIG. 3 is a front view of the putter head shown in FIG. 1 and an accompanying golf ball.
Figure 4:
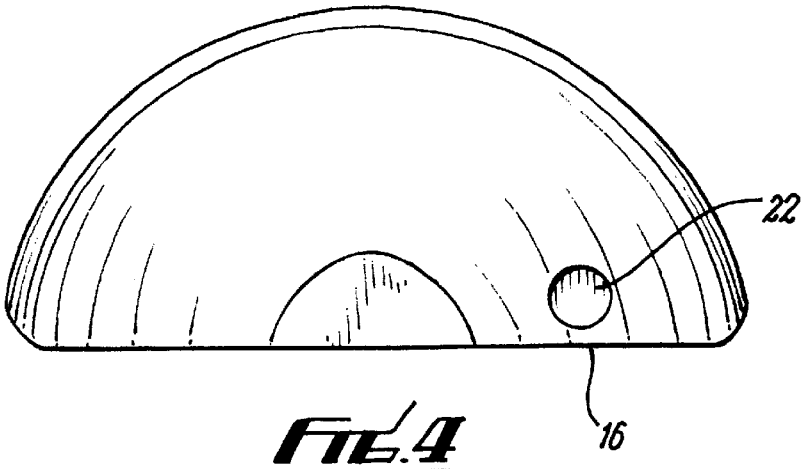
FIG. 4 is a plan view of the putter head shown in FIGS. 1 and 2.
Figure 5:
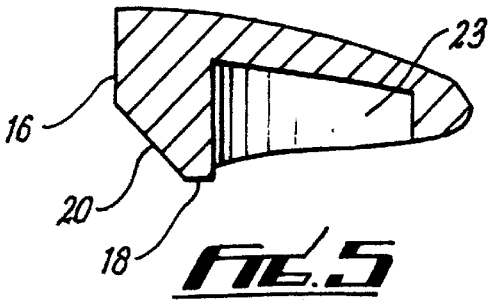
FIG. 5 is a section view of a putter head along the line AA' of FIG. 3.

The golf club 10 has a putter head 12 connected to a shaft 14. The putter head 12 comprises a front surface 16, a base surface 18 and is cut away in a region 20 between the front surface and the base surface. In the case of a right-handed golf putter the shaft 14 is connected to the putter head 12 at a point 22.

The putter head 12 also has a portion 23 cut away from the base surface and up into the body of the putter head.

The putter head 12 may be cast or machined from metal or a metal alloy. Alternatively, the putter head may be of any suitable material.

Additional weights, such as a lead weight, or an equivalent, may be included in the putter head if necessary in order that the putter head is of a standard weight or to alter the balance of the putter head.

When the putter is used to strike a golf ball the base surface 18 of the putter head 12 is held slightly above the ground and the front surface 16 makes contact with the ball. The cut away region 20 which extends downwards at an angle of approximately 45°, in a direction away from the front surface causes the front surface 16 to be located above the level of the base surface 18 . The height of the front surface 16 above the base surface 18 is such that the front surface 16 can make contact with a ball at the equator of the ball but not substantially below the equator of the ball.

The cut away region 20 also acts to provide a putter head with a higher centre of gravity compared to known types of putter. This feature together with the removed possibility of making contact with a ball substantially below the equator produces little or no skidding of the ball across the ground immediately after contact is made. Consequently, the putter provides a golfor with the ability to strike golf balls with improved consistency in respect of the roll of the ball.

It is of course to be understood that the invention is not intended to be restricted to the details of the above embodiment and many variations and modifications are possible.

What is claimed is:

1. A golf putter comprising a putter head with a front surface intended to make contact with a golf ball and a base surface intended to rest on or be closely adjacent to the ground when the front surface makes contact with a golf ball, said front surface being located above the level of the base surface and said front surface and the base surface being not adjacent, the center of gravity of the putter head being located above the level of the center of a golf ball resting on the ground when the base surface of the putter is closely adjacent to the ground.

2. A golf putter as claimed in claim 1, wherein the putter head has an angled cut away portion adjacent to the front surface and the base surface.

3. A golf putter as claimed in claim 2, wherein the angled portion is sized so that the height of the front surface above the base surface enables the front surface to make contact with a golf ball at the equator of the ball but not substantially below the equator of the ball.

4. A golf putter as claimed in claim 1, wherein the putter head has an angled cut away portion adjacont to the front surface and the base surface, wherein the cut away portion extends downwards at an angle of approximately 45° in a direction away from the front surface and causes the front surface to be located above the level of the base surface.

5. A golf putter as claimed in claim 1, wherein the putter head is cast or machined from metal or a metal alloy.

6. A golf putter as claimed in claim 1, wherein the putter head is cast, moulded or extruded from a rubber or plastic material.

7. A golf putter as claimed in claim 1, wherein the putter head is provided with internal or external weights.

8. A golf putter as claimed in claim 1, wherein a portion of the base surface or other part of the body of the putter head is cut away so as to alter the weight of the putter head.

9. A golf putter as claimed in claim 1, wherein the base surface or other part of the body of the putter head is cut away and wherein the shape of the portion cut away is altered to effect the type of performance required of the putter head.

* * * * *